US005613437A

United States Patent [19]

Motoe et al.

[11] Patent Number: 5,613,437

[45] Date of Patent: Mar. 25, 1997

[54] MIMEOGRAPHIC PRINTING MACHINE HAVING A STENCIL PAPER CONVEYING DEVICE

[75] Inventors: Katsuro Motoe; Yoshikazu Hara, both of Tokyo, Japan

[73] Assignee: Riso Kagaku Corporation, Tokyo, Japan

[21] Appl. No.: 337,226

[22] Filed: Nov. 7, 1994

[30] Foreign Application Priority Data

Nov. 9, 1993 [JP] Japan ..... 5-279640

[51] Int. Cl.[6] ..... B41L 13/06; B41L 13/14

[52] U.S. Cl. ..... 101/128.4; 101/477

[58] Field of Search ..... 101/116, 117, 101/118, 128.1, 128.21, 128.4, 129, 477, DIG. 36; 400/630, 621

[56] References Cited

U.S. PATENT DOCUMENTS

| | | | |
|---|---|---|---|
| 3,585,928 | 6/1971 | Kaneko | 101/477 |
| 4,628,813 | 12/1986 | Hasegawa et al. | 101/116 |
| 5,123,583 | 6/1992 | Kato et al. | 400/618 |
| 5,346,322 | 9/1994 | Okamori | 400/630 |

FOREIGN PATENT DOCUMENTS

| | | | |
|---|---|---|---|
| 59-143679 | 8/1984 | Japan . | |
| 279979 | 12/1987 | Japan | 101/116 |
| 290572 | 12/1987 | Japan | 101/477 |
| 153196 | 6/1988 | Japan | 101/128.4 |
| 103472 | 4/1989 | Japan | 400/630 |
| 2-098480 | 4/1990 | Japan . | |

OTHER PUBLICATIONS

IBM Technical Disclosure Bulletin, vol. 22 No. 7 Dec. 1979, "Dual Motor Forms Feed Drive", Bateson et al.

*Primary Examiner*—Stephen R. Funk

*Attorney, Agent, or Firm*—Sughrue, Mion, Zinn, Macpeak & Seas

[57] ABSTRACT

In a mimeographic printing machine in which a mimeographic stencil paper is initially set in such a manner that the front leading end of the mimeographic stencil paper is located in a stencil paper passageway between a stencil making device and a rotary cylindrical printing drum, the mimeographic printing machine has a stencil paper conveying device, a stencil paper sensor and controller. The controller controls the stencil paper conveying device as follows: In the case where the stencil paper sensor does not detect the presence of the stencil paper when the stencil paper is initially set, the controller causes the stencil paper conveying device to forwardly move the stencil paper until, after the sensor detects the passage of the front leading end of the stencil paper, the front leading end of the stencil paper reaches a predetermined position. On the other hand, in the case where the sensor detects the presence of the stencil paper when the stencil paper is initially set, the controller causes the stencil paper conveying device to backwardly move the stencil paper until the sensor detects the passage of the front leading end of the stencil paper, and then to forwardly move the stencil paper until, after the sensor detects the passage of the front leading end of the stencil paper, the front leading end of the stencil paper reaches the predetermined position.

4 Claims, 4 Drawing Sheets

MIMEOGRAPHIC PRINTING MACHINE HAVING A STENCIL PAPER CONVEYING DEVICE

BACKGROUND OF THE INVENTION

1. Field of the Invention

This invention relates to mimeographic printing machines, and more particularly to a mimeographic printing machine having stencil making means in which a mimeographic stencil paper is initially set in such a manner that the front leading end of the stencil paper is positioned in a mimeographic stencil paper passageway between the stencil making means and a rotary cylindrical printing drum.

2. Description of the Prior Art

A mimeographic printing machine is well known in the art in which a continuous-sheet-shaped mimeographic stencil paper is supplied to stencil making means, where the stencil paper is processed to provide a stencil while being conveyed towards a rotary cylindrical printing drum by a platen roller and others in the stencil making means, and the stencil paper thus processed is conveyed to the rotary cylindrical printing drum by the platen roller and master feed rollers provided ahead of the platen roller so that the stencil is set on the drum. An example of the machine has been disclosed, for instance, by Unexamined Japanese Patent Publication (OPI) No. Sho. 59-143679 (the term "OPI" as used herein means an "unexamined publication").

In the above-described conventional machine, a new stencil paper is initially set in the stencil making section by hand. In this initial stencil paper setting operation, the stencil paper is liable to be variable in set position. In order to overcome this difficulty, after the stencil paper is set in the above-described manner, the following method is employed: That is, a stencil paper cutter is provided in the stencil paper passageway between the stencil making means and the rotary cylindrical printing drum. The front leading end portion of the stencil paper thus set is cut with the cutter so that the front leading end of the stencil paper is at the predetermined initial position.

However, the above-described method of setting the front leading end of the stencil paper at the predetermined initial position is disadvantageous in the following points: When the front leading end portion of the stencil paper is cut, a piece of stencil paper is formed as a waste at the end, remaining in the stencil paper passageway. It must be removed by the operator. If the machine is operated without removal of the waste from the stencil paper passageway, then it will obstruct the conveyance of the stencil paper in the machine, and may stick on the outer surface of the rotary cylindrical printing drum, thus adversely affecting the printing operation.

Furthermore, after the stencil paper is fed forward rapidly, its front leading end portion is cut with the stencil paper cutter as was described above. Hence, the cut portion of the stencil paper is wasted.

SUMMARY OF THE INVENTION

In view of the above-described difficulties accompanying a conventional mimeographic printing machine, an object of the invention is to provide a mimeographic printing machine which is free from the difficulty that, in initially setting a mimeographic stencil paper therein, its front leading end is cut to form a piece of stencil paper as a waste, and accordingly from a troublesome operation of removing the waste, and in which the stencil paper is not wasted at all when initially positioned.

The foregoing object of the invention has been achieved by the provision of a mimeographic printing machine in which a mimeographic stencil paper is initially set in such a manner that the front leading end of the mimeographic stencil paper is located in a stencil paper passageway between stencil making means and a rotary cylindrical printing drum, which, according to the invention, comprises stencil paper conveying means, a stencil paper sensor and control means. The control means controls the stencil paper conveying means as follows: In the case where the stencil paper sensor does not detect the presence of the stencil paper when the stencil paper is initially set, the control means causes the stencil paper conveying means to forwardly move the stencil paper until, after the sensor detects the passage of the front leading end of the stencil paper, the front leading end of the stencil paper reaches a predetermined position. On the other hand, in the case where the sensor detects the presence of the stencil paper when the stencil paper is initially set, the control means causes the stencil paper conveying means to backwardly move the stencil paper until the sensor detects the passage of the front leading end of the stencil paper, and then to forwardly move the stencil paper until, after the sensor detects the passage of the front leading end of the stencil paper, the front leading end of the stencil paper reaches the predetermined position.

The mimeographic printing machine thus organized operates as follows:

In the case where the stencil paper is initially set with the front leading end of the latter located before the stencil paper sensor, the latter does not detect the presence of the stencil paper. Hence, the stencil paper is forwardly conveyed by the stencil paper conveying means until, after the stencil paper sensor detects the passage of the front leading end of the stencil paper, the front leading end of the stencil paper reaches the predetermined position.

In the case where the initial stencil paper setting operation is carried out with the front leading end of the stencil paper moved over the stencil paper sensor, the latter detects the presence of the stencil paper. Hence, the stencil paper is backwardly conveyed by the stencil paper conveying means until the sensor detects the passage of the front leading end of the stencil paper, so that the front leading end of the stencil paper is located before the sensor. Thereafter, the stencil paper is forwardly conveyed by the stencil paper conveying means until, after the sensor detects the passage of the front leading end of the stencil paper, the front leading end of the stencil paper reaches the predetermined position.

Thus, in both cases, the front leading end of the stencil paper is set at the predetermined position.

DETAILED DESCRIPTION OF THE PREFERRED EMBODIMENTS

One preferred embodiment of the invention will be described with reference to the accompanying drawings in detail.

Figure 1:
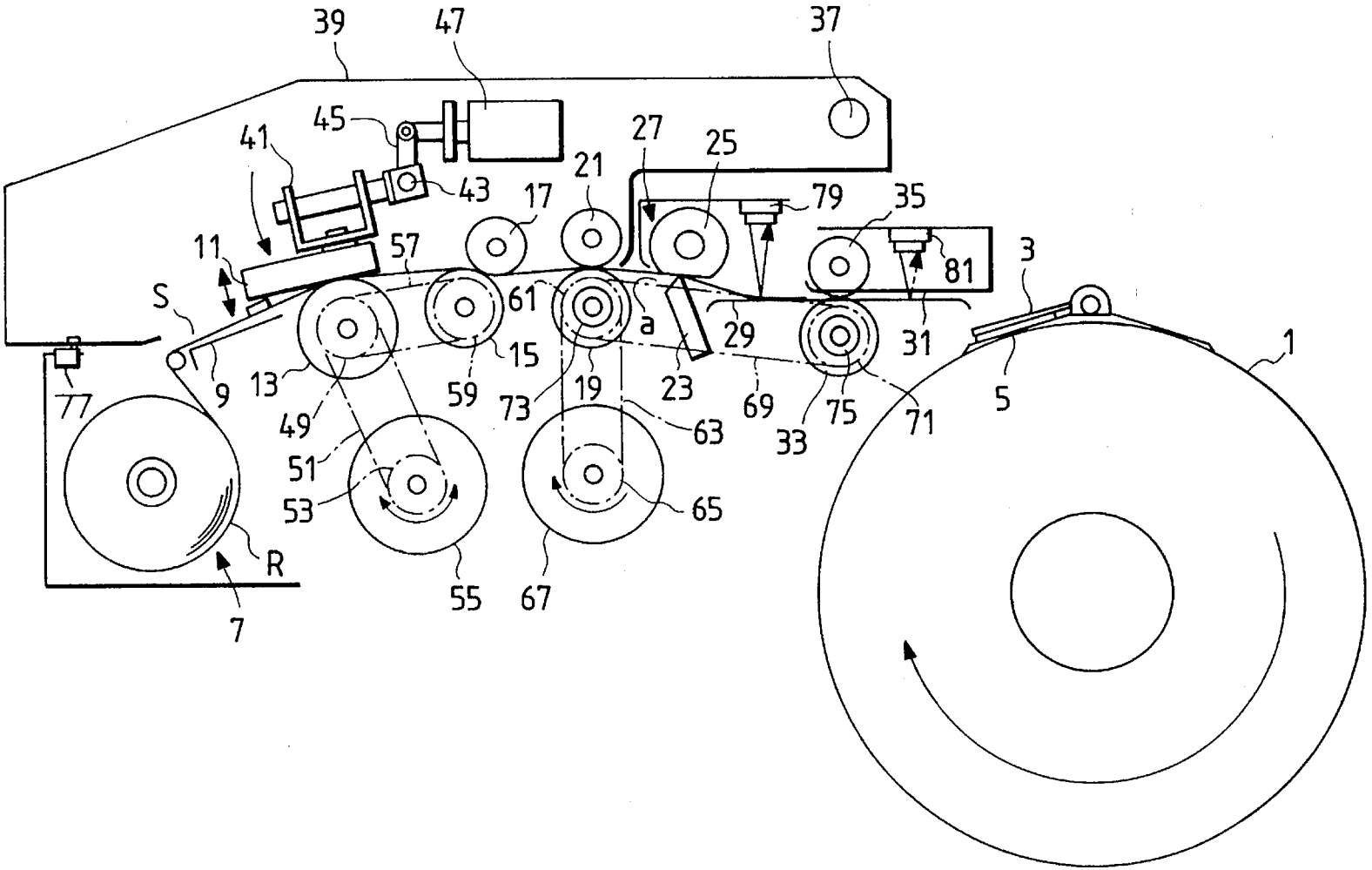
FIG. 1 is a side view showing essential components of a mimeographic printing machine according to the invention.

FIG. 1 shows an example of a mimeographic printing machine. In FIG. 1, reference numeral 1 designates a rotary cylindrical printing drum. The cylindrical printing drum 1 has a stencil paper clamping piece 5 on its outer surface, which cooperates with a stage surface member 3 to clamp a mimeographic stencil paper S. The cylindrical printing drum 1 is rotated clockwise in FIG. 1 by an electric motor (not shown).

A stencil paper holding section 7 is provided on the left of the cylindrical printing drum 1 in FIG. 1, which is adapted to detachably hold a roll R of the stencil paper S. The stencil paper S is belt-shaped and heat-sensitive.

Between the stencil paper holding section 7 and the cylindrical printing drum 1, the following components are arranged in the stated order: a stencil paper guiding lower board 9, a thermal head 11 for thermally making a stencil, a platen roller 13 arranged confronted with the thermal head 11, a first stencil paper feed roller 15, a pinch roller 17 arranged on the feed roller 15, a second stencil paper feed roller 19, a pinch roller 21 arranged on the feed roller 19, a stencil paper cutter 27 comprising a stationary blade 23 and a movable blade 25 provided above the blade 23, a stencil paper guiding lower board 29, a stencil paper guiding upper board 31 provided over the lower board 29, a third stencil paper feed roller 33, and a pinch roller 35 arranged on the latter 33.

The stencil paper guiding lower board 9, the platen roller 13, the first stencil paper feed roller 15, the second stencil paper feed roller 19, the stationary blade 23, the stencil paper guiding lower board 29, the stencil paper guiding upper board 31, the third stencil paper feed roller 33, and the pinch roller 35 are arranged on the frame of the machine body. The thermal head 11, and the pinch rollers 17 and 21 are arranged on a pressure plate cover 39 which is vertically swingable about a shaft 37, so that those components 11, 17 and 21 are moved into and out of engagement with the platen roller 13, the first stencil paper feed roller 15, and the second stencil paper feed roller 19, respectively.

The thermal head 11 is supported through a bracket 41 on the frame of the pressure plate cover 39 in such a manner that it is swingable about a shaft 43 substantially vertically. A stencil making solenoid 47 is coupled through a lever 45 to the shaft 43 of the thermal head 11. When, with the cover 39 closed, the solenoid 47 is energized, it applies a force to the thermal head 11 so that the latter 11 is pushed against the platen roller 13.

The platen roller 13 is coupled through a pulley 49, a timing belt 51, and a pulley 53 to a writing feed motor 55 8 which is a step motor, so that it is turned in both directions, forward direction and reverse direction, by the motor 55. The first stencil paper feed roller 15 is coupled through the pulley 49, a timing belt 57, and a pulley 59 to the platen roller 13, so that it is turned in the same direction as the platen roller 13; that is, the feed roller 15 and the platen roller 13 are rotated in synchronization with each other.

The second stencil paper feed roller 19 is coupled through a pulley 61, a timing belt 63, and a pulley 65 to a stencil-setting feed motor 67 which is a step motor, so that it is turned clockwise in FIG. 1; i.e., in the forward direction.

The third stencil paper feed roller 33 is coupled through a pulley 61, a timing belt 69, and a pulley 71 to the second stencil paper feed roller 19, so that it is turned in the same direction as the feed roller 19; that is, those feed rollers 33 and 19 are turned in synchronization with each other.

A one-way clutch 73 is provided between the second stencil paper feed roller 19 and the pulley 61. Similarly, a one-way clutch 75 is provided between the third stencil paper feed roller 33 and the pulley 71. The one-way clutches 73 and 75 permit the second and third stencil paper feed rollers 19 and 33 to freely turn counterclockwise in FIG. 1; i.e., in the direction which is opposite to the paper feeding direction.

A pressure-plate-cover switch 77 is provided on the frame of the machine body which is turned on when the pressure plate cover 39 is closed as shown in FIG. 1.

A master set sensor (mimeographic stencil paper sensor) 79 is provided in a mimeographic stencil paper passageway between the stencil paper cutter 27 and the third stencil paper feed roller 33 engaged with the pinch roller 35. The sensor 79 is used to optically detect the presence or absence of the stencil paper S there.

A master feed sensor 81 is provided in the mimeographic stencil paper passageway between the third stencil paper feed roller 33 engaged with the pinch roller 35 and a stencil-setting start region of the cylindrical printing drum 1. The sensor 81 is also used to optically detect the presence or absence of the stencil paper S there.

Figure 2:
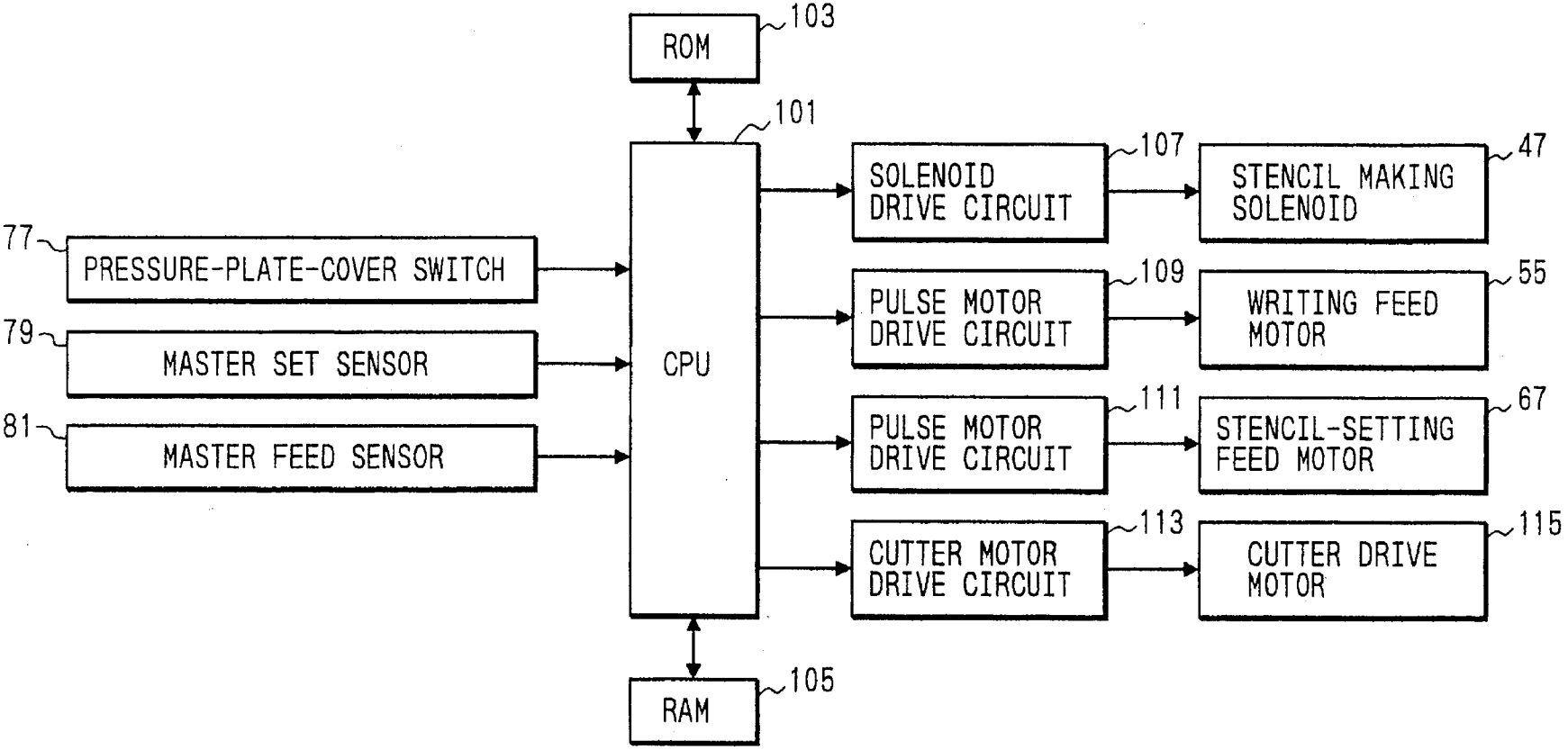
FIG. 2 is a block diagram showing a control system for a stencil paper supplying section in the machine according to the invention.

FIG. 2 shows an example of a control system for a stencil paper supplying section in the mimeographic printing machine thus organized. The control system comprises: CPU including a microprocessor or the like; ROM 103 having control programs; and RAM 105 for storing input data, timer measurement values, motor step numbers, etc. when required. The CPU 101 receives the outputs of the pressure plate cover switch 77, the master set sensor 79 and the master feed sensor 81, and applies operating instructions to a solenoid drive circuit 107, pulse motor drive circuits 109 and 111, and a cutter motor drive circuit 113.

The solenoid drive circuit 107 is connected to a stencil making solenoid 47, the pulse motor drive circuit 109 to a writing motor 55, and the pulse motor drive circuit 111 to the stencil-setting feed motor 67. The cutter motor drive circuit 113 is connected to a cutter drive motor 115 adapted to turn the movable blade 25.

The CPU 101 executes the control program. Fundamentally, the CPU 101 operates as follows: In the case where, in an initial stencil paper setting operation with the closure of the pressure plate cover 39 detected by the pressure-plate-cover switch 77, the master set sensor 79 does not detect the presence of the stencil paper S yet, the CPU operates to rotate both the writing motor 55 and the stencil-setting feed motor 67 in the forward direction to convey the stencil paper S forwardly until, after the master set sensor 79 detects the passage of the front leading end of the stencil paper S, the front leading end of the latter S reaches a predetermined position. On the other hand, in the case where the master set sensor 79 detects the presence of the stencil paper S, the CPU 101 operates to rotate the writing motor 55 in the reverse direction to feed the stencil paper S backwardly until the master set sensor 79 detects the passage of the front leading end of the stencil paper S. And thereafter, the CPU 101 operates to rotate both the writing motor 55 and the stencil-setting feed motor 67 in the forward direction to convey the stencil paper S forwardly until, after the master set sensor 79 detects the passage of the front leading end of the stencil paper S, and the front leading end of the latter S reaches the predetermined position.

In a stencil forming step and in a stencil setting step, the CPU 101 receives a signal from the master feed sensor 81. In the case where the master feed sensor 81 does not detect the passage of the front leading end of the stencil paper S within a predetermined period of time from the start of the stencil making operation, and in the case where the master feed sensor 81 does not detect the passage of the trailing end of the stencil paper S within a predetermined period of time from the instant that the stencil paper is cut by the stencil paper cutter 27, then the CPU 101 determines that trouble has occurred with the conveyance of the stencil paper, and takes necessary action, for instance stopping the operations of the relevant operating units.

Figure 3:
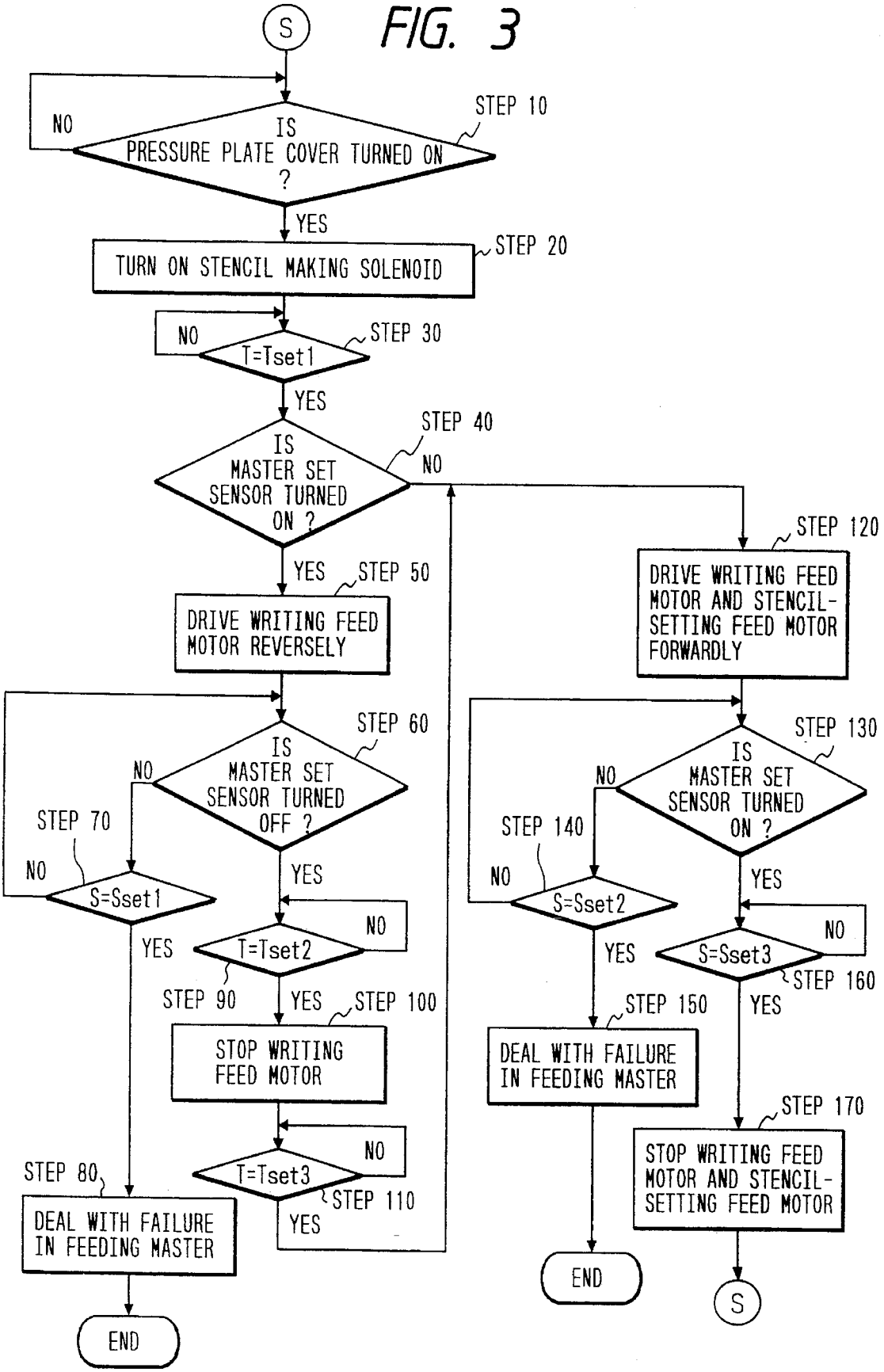
FIG. 3 is a flow chart for a description of the operation of a stencil paper supply control system in the machine of the invention.

FIGS. 3 and 4 are a flow chart and a time chart, respectively, showing the operations of the stencil paper supply control system in the mimeographic printing machine according to the invention.

With the pressure plate cover 39 opened upwardly, the roll R of stencil paper (S) is initially set in the stencil paper holding section 7. The front leading end portion of the stencil paper is separated from the roll in the holding section 7, and is extended over the platen roller 13, the first stencil paper feed roller 15 and the second stencil paper feed roller 18 and then inserted into the stencil paper inlet a of the stencil paper cutter 27. Thereafter, the stencil paper is fed by hand until its front leading end reaches the upper surface of the stencil paper guiding lower board 29 after passing through the stationary blade 23 and the movable blade 25.

After the stencil sheet S has been initially set as was described above, it is observed whether or not the pressure-plate-cover switch 77 is turned on; that is, whether or not the pressure plate cover 39 is closed as shown in FIG. 1 (Step 10).

When the switch 77 is turned on, the solenoid 47 is energized (Step 20), so that the thermal head 11 is pushed against the platen roller 13.

A predetermined period of time Tset1 (approximately 500 m sec) after the solenoid 47 is energized (Step 30), it is determined whether or not the master set sensor 79 is in "on" state; that is, whether or not the stencil paper S has been fed to the master set sensor by hand (Step 40).

If the master set sensor 79 is in "on" state; that is, if the front leading end of the stencil paper S is moved over the master set sensor 79 in the initial stencil paper setting operation, then the writing motor 55 is turned in the reverse direction (Step 50), to turn the platen roller 13 and the first stencil paper feed roller 15 counterclockwise (in FIG. 1), so that the stencil paper S is moved back to the left in FIG. 1 with the second stencil paper feed roller 19 being freely turned with the aid of the one-way clutch 73.

In the case where the writing motor 55 is turned in the reverse direction, it is detected whether or not the master set sensor 79 is placed in an "off" state within a period of time corresponding to a predetermined number of drive steps Sset1 (corresponding to a feed of approximately 50 mm for instance); that is, whether or not the front leading end of the stencil paper S has moved back across the master set sensor 79 within the period of time corresponding to the predetermined number of drive steps Sset1 (Steps 60 and 70).

If the master set sensor 79 is not placed in the "off" state within the period of time corresponding to the predetermined number of drive steps Sset1, necessary actions are taken, for instance stopping the operations of the related driving units (Step 80).

When the master set sensor 79 is placed in the "off" state within the period of time corresponding to the predetermined number of drive steps Sset1, a predetermined period of time Tset2 (approximately 100 m sec) thereafter the rotation of the writing motor 55 in the reverse direction is stopped (Steps 90 and 100), so that the backward movement of the stencil paper S to the left in FIG. 1 by the platen roller 13 and the first stencil paper feed roller 15 is stopped.

The backward movement of the stencil paper S for the predetermined period of time Tset2 is to prevent the output signal of the master set sensor 79 from chattering due to the variation in position of the front leading end of the stencil paper S which is caused for instance when it is curled.

A predetermined period of time Tset3 (approximately 100 m sec) after the reverse rotation of the writing motor 55 (Step 110), the writing motor 55 and the stencil-setting feed motor 67 are turned in the forward direction (Step 120), so that the platen roller 13, the first stencil paper feed roller 15, the second stencil paper feed roller 19, and third stencil paper feed roller 33 are turned clockwise in FIG. 1, to forward the stencil paper S to the right.

In this operation (when the writing motor 55 and the stencil-setting feed motor 67 are turned in the forward direction), it is monitored whether or not master set sensor 79 is placed in an "on" state within a period of time corresponding to a predetermined number of drive steps Sset2 (corresponding to the amount of feed of approximately 50 mm for instance); that is, whether or not the front leading end of the stencil paper S is moved over the master set sensor 79 within the period of time corresponding to the predetermined number of drive steps Sset2 (Steps 130 and 140).

If the master set sensor 79 is not placed in the "on" state within the period of time corresponding to the predetermined number of drive steps Sset2, necessary actions are taken, for instance stopping the operations of the relevant operating units (Step 150).

Where the master set sensor 79 is placed in the "on" state within the period of time corresponding to the predetermined number of drive steps Sset2, the writing motor 55 and the stencil-setting feed motor 67 are turned in the forward direction (Step 160) for a period of time corresponding to a predetermined number of drive steps Sset3 (corresponding to the amount of feed of approximately 10 mm for instance). Thereafter, the forward rotation of those two motors 55 and 67 is stopped (Step 170), so that the forward movement of the stencil paper S to the right in FIG. 1 by the platen roller 13, the first stencil paper feed roller 15 and the second stencil paper feed roll 19 is stopped. Thus, the front leading end of the stencil paper is set to come to the predetermined position.

in the case where, in Step 40, the master set sensor 79 is not in the "on" state; that is, the stencil paper S is initially set in such a manner that the front leading end of the stencil paper S does not reach the master set sensor 79, Step 120 is effected. In succession to Step 120, Steps 130, 160 and 170 are effected. That is, the writing motor 55 and the stencil-setting feed motor 67 are rotated in the forward direction to feed the stencil paper S to the right in FIG. 1. After the master set sensor 79 is placed in the "on" state, those motors 55 and 67 are continuously turned in the forward direction for a period of time corresponding to the predetermined number of drive steps Sset3, and then stopped, so that the forward movement of the stencil paper S to the right in FIG. 1 by the platen roller 13, the first stencil paper feed roller 15 and the second stencil paper feed roller 15 is stopped. In this case too, the front leading end of the stencil paper S comes to the predetermined position similarly as in the case where the stencil paper S is initially set in such a manner that its front leading end is located between the cylindrical printing drum 1 and the master set sensor 79.

As was described above, the writing motor 55 and the stencil-setting feed motor 67 are continuously rotated for the period of time corresponding to the predetermined number of drive steps Sset3 from the instant that the master set sensor 79 is turned on. This is to prevent the output signal of the master set sensor 79 from chattering due to the variation in position of the front leading end of the stencil paper S which is caused for instance when it is curled.

Figure 4A:
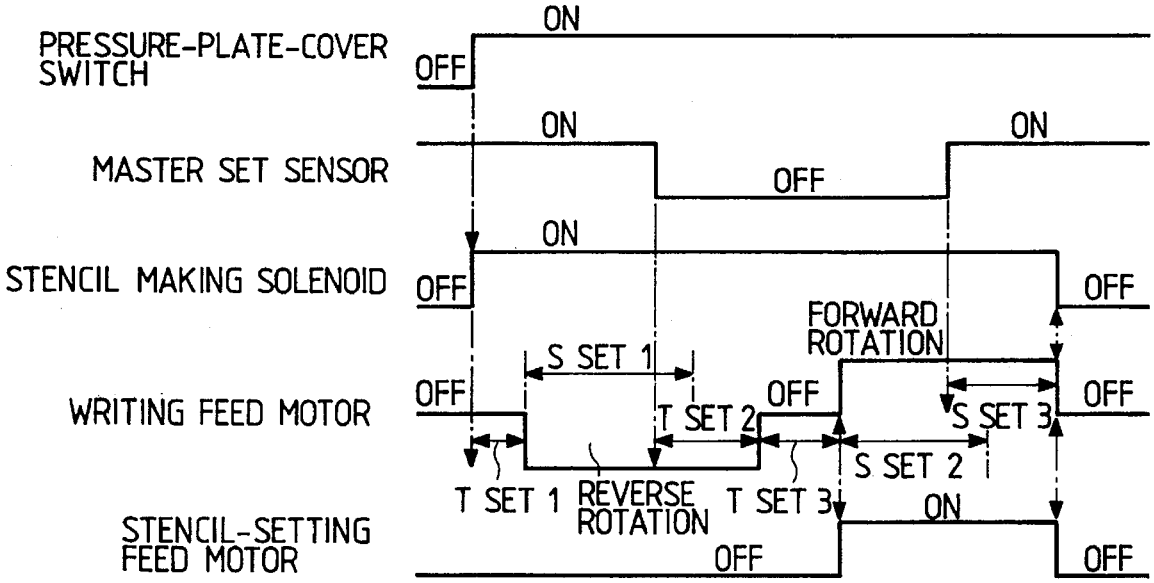
FIGS. 4(A) and 4(B) are time charts for a description of the operation of the stencil paper supply control system in the machine of the invention.
Figure 4B:
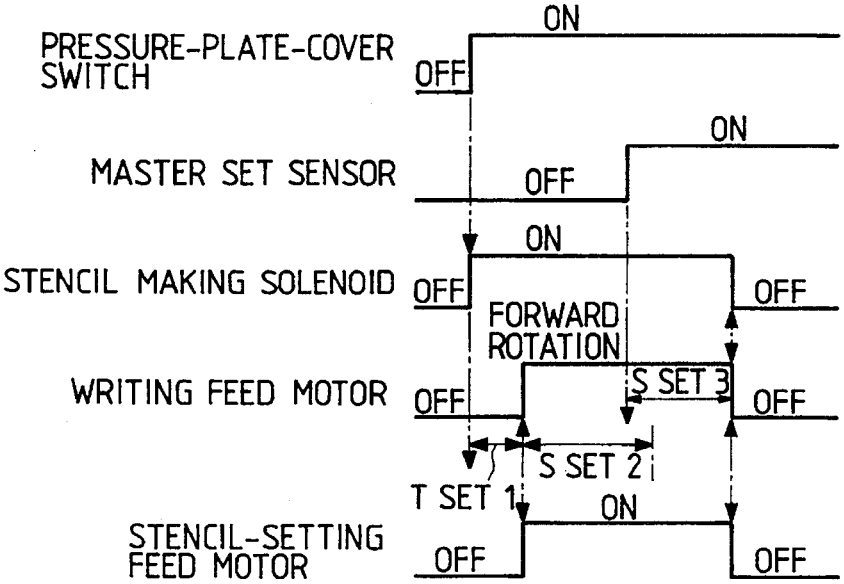

FIG. 4(A) is a time chart for a description of the operation of the mimeographic printing machine in the case where the stencil paper S is initially set with the front leading end of the stencil paper S located downstream of the master set sensor 79; and FIG. 4(B) is a time chart for a description of the operations of the machine in the case where the stencil paper S is initially set with the front leading end of the stencil paper S located upstream of the master set sensor 79.

As is apparent from the above description, both in the case where the initial stencil paper setting operation is carried out with the front leading end of the stencil paper located before the stencil paper sensor (master set sensor), and in the case where it is carried out with the front leading end of the stencil paper moved over the stencil paper sensor, the position of the front leading end of the stencil paper is adjusted to come to the predetermined position merely by moving the stencil paper, so that the initial stencil paper setting operation is achieved correctly. This eliminates the above-described difficulty that the front leading end portion of the stencil paper must be cut to locate the front leading end of the latter at the predetermined position in the initial stencil paper setting operation, and accordingly that the troublesome work of removing the piece of stencil paper which is formed as a waste by cutting the front leading end portion of the stencil paper. Thus, the stencil paper is not wasted at all in initially setting it in the mimeographic printing machine.

What is claimed is:

1. A mimeographic printing machine having a stencil making device, a rotary cylindrical printing drum, a stencil paper passageway between the stencil making device and the printing drum, and a cutter in the stencil paper passageway, and in which a mimeographic stencil paper is initially set in such a manner that a front leading end of the mimeographic stencil paper is located in the stencil paper passageway between the the cutter and the rotary cylindrical printing drum, said mimeographic printing machine comprising:

stencil paper conveying means which is driven selectively in a forward direction or in a reverse direction to selectively carry out a forward conveyance of conveying the stencil paper from the stencil making device towards the cylindrical printing drum or a reverse conveyance of returning the stencil paper towards the stencil making device;

a stencil paper sensor provided in the stencil paper passageway between the cutter and the rotary cylindrical drum, for detecting the presence or absence of the stencil paper therein; and control means for controlling said stencil paper conveying means as follows:

in the case where said sensor does not detect the presence of the stencil paper when the stencil paper is initially set, said control means causes said stencil paper conveying means to forwardly move the stencil paper until, after said sensor detects the passage of the front leading end of the stencil paper, the front leading end of the stencil paper reaches a first predetermined position between the stencil paper sensor and the rotary cylindrical printing drum, and in the case where said sensor detects the presence of the stencil paper when the stencil paper is initially set, said control means causes said stencil paper conveying means to backwardly move the stencil paper until, after said sensor detects the passage of the front leading end of the stencil paper, the front leading end of the stencil paper reaches a second predetermined position between the stencil paper sensor and the cutter, and then to forwardly move the stencil paper until, after said sensor detects the passage of the front leading end of the stencil paper, the front leading end of the stencil paper reaches said first predetermined position.

2. A mimeographic printing machine according to claim 1, wherein said stencil paper conveying means further comprises a first stencil paper feed roller located upstream of said stencil paper sensor in the paper passageway, a first motor for driving said first stencil paper feed roller forwardly and backwardly in accordance with said control means, a second stencil paper feed roller located in the paper passageway between said stencil paper sensor and said first stencil paper feed roller, a second motor for driving said second stencil paper feed roller, and a one way clutch connecting between said second stencil paper roller and said second motor, said one way clutch transmitting the forward rotation of said second motor to said second stencil paper roller and allowing the backward rotation of said second stencil paper roller free from said second motor.

3. A mimeographic printing machine according to claim 1, further comprising a stencil paper feed sensor located in the stencil paper passageway between said stencil paper sensor and the rotary cylindrical printing drum.

4. A mimeographic printing machine having a stencil making device, a rotary cylindrical printing drum and a stencil paper passageway therebetween, and in which a mimeographic stencil paper is initially set in such a manner that a front leading end of the mimeographic stencil paper is located in the stencil paper passageway between the stencil making device and the rotary cylindrical printing drum, said mimeographic printing machine comprising:

stencil paper conveying means which is driven selectively in a forward direction or in a reverse direction to selectively carry out a forward conveyance of conveying the stencil paper from the stencil making device towards the cylindrical printing drum or a reverse conveyance of returning the stencil paper towards the stencil making device;

a stencil paper sensor provided in the stencil paper passageway, for detecting the presence or absence of the stencil paper therein;

control means for controlling said stencil paper conveying means as follows:

in the case where said sensor does not detect the presence of the stencil paper when the stencil paper is initially set, said control means causes said stencil paper conveying means to forwardly move the stencil paper until, after said stencil paper sensor detects the passage of the front leading end of the stencil paper, the front leading end of the stencil paper reaches a first predetermined position, and in the case where said stencil paper sensor detects the presence of the stencil paper when the stencil paper is initially set, said control means causes said stencil paper conveying means to backwardly move the stencil paper until, after said stencil paper sensor detects the passage of the front leading end of the stencil paper, the front leading end of the stencil paper reaches a second predetermined position, and then to forwardly move the stencil paper until, after said stencil paper sensor detects the passage of the front leading end of the stencil paper, the front leading end of the stencil paper reaches said first predetermined position; and a stencil paper feed sensor disposed in the stencil paper passageway between said stencil paper sensor and the rotary cylindrical printing drum.

* * * * *